US005797155A

United States Patent [19]

Maier et al.

[11] Patent Number: 5,797,155

[45] Date of Patent: Aug. 25, 1998

[54] WHEELCHAIR CUSHION WITH PROTECTIVELY ENCASED SELF-ADJUSTING RESERVOIR MEANS

[75] Inventors: Edmund K. Maier; Richard W. Raburn, both of Simpsonville, S.C.

[73] Assignee: Span-America Medical Systems, Inc., Greenville, S.C.

[21] Appl. No.: 870,526

[22] Filed: Jun. 6, 1997

Related U.S. Application Data

[60] Provisional application No. 60/019,819, Jun. 7, 1996.

[51] Int. Cl.[6] ..... A47C 27/18; A47C 27/10; A61G 7/057

[52] U.S. Cl. ..... 5/654; 5/709; 297/284.6; 297/452.41; 297/DIG. 3

[58] Field of Search ..... 5/654, 706, 707, 5/709, 710, 655.3, 653; 297/284.6, 452.41, DIG. 3

[56] References Cited

U.S. PATENT DOCUMENTS 5,446,933 9/1995 Gabblehouse ..... 5/933
5,634,224 6/1997 Gates ..... 5/654
5,649,331 7/1997 Wilkinson et al. ..... 5/710
5,652,985 8/1997 Wilkson et al. ..... 5/654

*Primary Examiner*—Alexander Grosz
*Attorney, Agent, or Firm*—Doriy & Manning, PA

[57] ABSTRACT

A seating system is designed for self-adjusting pressure relief for use with wheelchairs and other generally confined seating arrangements. One or more support chambers filled with resilient foam and a fluid such as air are arranged on an upper support surface. Respective self-adjusting reservoirs are provided and arranged in fluid communication (such as through plastic tubing) with various of the chambers. As elastic band or similar is placed surrounding each respective reservoir, to compensate for, and reach equilibrium with, air pressure differences caused therein by the amount of force or loading received on the corresponding respective support chamber. The physical placement of the reservoir arrangements may be accommodated within an enclosing cover, so that an integrally formed self-contained wheelchair cushion or similar is provided with self-adjusting features, operative in respective zones of the support surface.

31 Claims, 10 Drawing Sheets

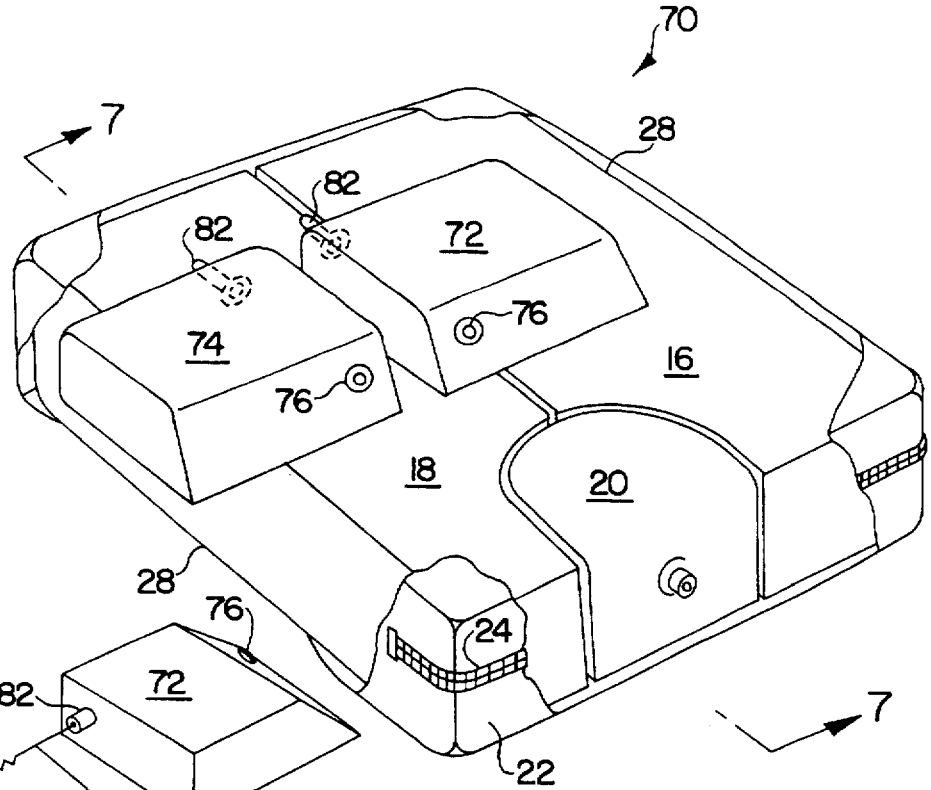
FIG. 6A
FIG. 6B
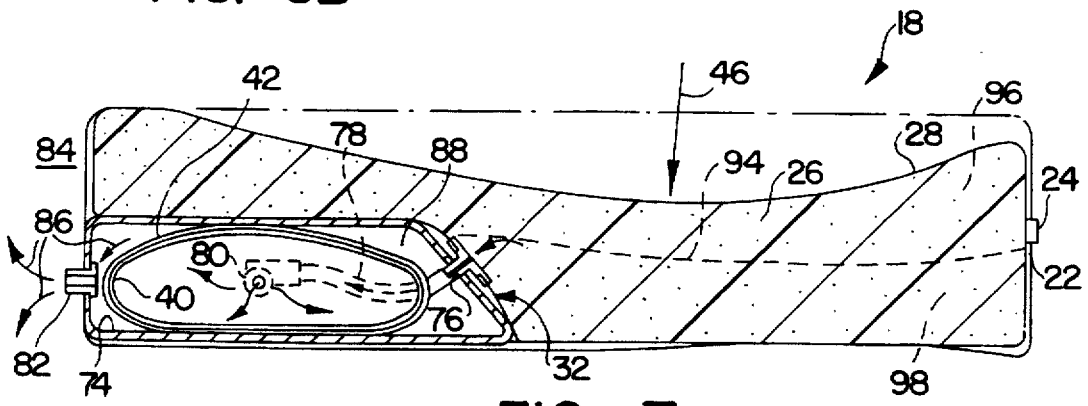
FIG. 7

WHEELCHAIR CUSHION WITH PROTECTIVELY ENCASED SELF-ADJUSTING RESERVOIR MEANS

PRIORITY CLAIM

This application is based on a Provisional Application having U.S. Ser. No. 60/019,819 filed Jun. 7, 1996, and priority is hereby claimed therefrom.

BACKGROUND OF THE INVENTION

This invention generally relates to the field of pressure relief and more particularly to self-adjusting pressure relief seating systems and to corresponding methodologies.

There has been a long term need in the field of health care (both for in hospital and home patients) to provide pressure relief for immobile or otherwise confined patients. Many patients are subjected to long term confinement, such as use of a wheelchair or other accommodating but generally restrictive support arrangement. Such arrangements give rise to a tremendous risk of exposure to excess pressures, resulting potentially in painful and even dangerous pressure sores and other conditions.

Pressure sores, such as decubitus ulcers, constitute a form of tissue trauma. Tissue damage can be monitored, rated, and treated, with progressive technologies. The difficulty in the modern health care field is to provide an effective therapeutic arrangement which is also cost effective.

In other instances, tissue traumas may be caused by burns, or other injuries, rather than simply due to excess pressure damage. In such circumstances, a similar need arises for effective therapeutic treatment in the context of a cost efficient approach.

Still other patients may have special needs arising from specific injuries, such as hip fractures or the like, requiring special support care during a specified recovery period.

Providing high quality product performance and methodology generally has involved the expense of more entailed and sophisticated technologies. Numerous support systems have been devised, potentially to face support arrangements where distinctly different loading requirements occur. Again, the more sophisticated an approach to address such differential support requirements, generally the greater the technical difficulty in executing a methodology and the greater the expense thereof.

SUMMARY OF THE INVENTION

The present invention is intended to recognize and address various of the foregoing problems, and others, concerning pressure relief systems and methodologies. Thus, broadly speaking, a principal object of this invention is improved pressure relief seating systems and methodologies. More particularly, a main concern is improved self-adjusting technology for wheelchair cushions and similar, without requiring the expense and complexity of relatively higher technologies.

One general object is to provide an improved self-adjusting pressure relief seating system, applicable to different seating conditions in either medical or consumer settings.

Another more specific object is to provide an improved system and methodology which does not require the use of external energy, nor the need for sensory feedback control or controlled pump and valving systems, while still providing a dynamic fluid-based system.

Another present general object is to provide a self-adjusting pressure relief system for optimizing pressure dispersion, while obviating the need for control systems or specialized training for use and maintenance of the equipment and methodology.

Another present object is to provide pressure relief support to allow for more even weight distribution in a self-adjusting system, for improving the reduction of pressure on the tissue and skin of a user.

Another present object is to provide a combination of advantages obtained with the use of resilient foam together with a self-adjusting fluid pressure relief system. Still another object is to provide a self-adjusting system of such compactness as to integrally fit into a cushion arrangement.

Additional objects and advantages of the invention are set forth in, or will be apparent to those of ordinary skill in the art from, the detailed description which follows. Also, it should be further appreciated that modifications and variations to the specifically illustrated and discussed features, steps, or materials hereof may be practiced in various embodiments and uses of this invention without departing from the spirit and scope thereof, by virtue of present reference thereto. Such variations may include, but are not limited to, substitution of equivalent means and features (or materials or steps) for those shown or discussed, and the functional or positional reversal of various parts, features, steps, or the like.

Still further, it is to be understood that different embodiments, as well as different presently preferred embodiments, of this invention, may include various combinations or configurations of presently disclosed features, steps, or elements, or their equivalents (including combinations of features or steps or configurations thereof not expressly shown in the figures or stated in the detailed description).

It is to be likewise understood that the present invention equally relates to methodologies corresponding with practice of the present devices disclosed herewith.

Those of ordinary skill in the art will better appreciate the features and aspects of such embodiments and methodologies, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which:

FIG. 6A is a generally top and rear perspective view (in partial cutaway) of a second exemplary embodiment in accordance with the subject invention;

FIG. 6B is a generally top and side perspective view of a select component of the second embodiment of FIG. 6A;

FIG. 7 is a generally cross sectional view taken along the section line 7—7 of present FIG. 6A;

Figure 1:
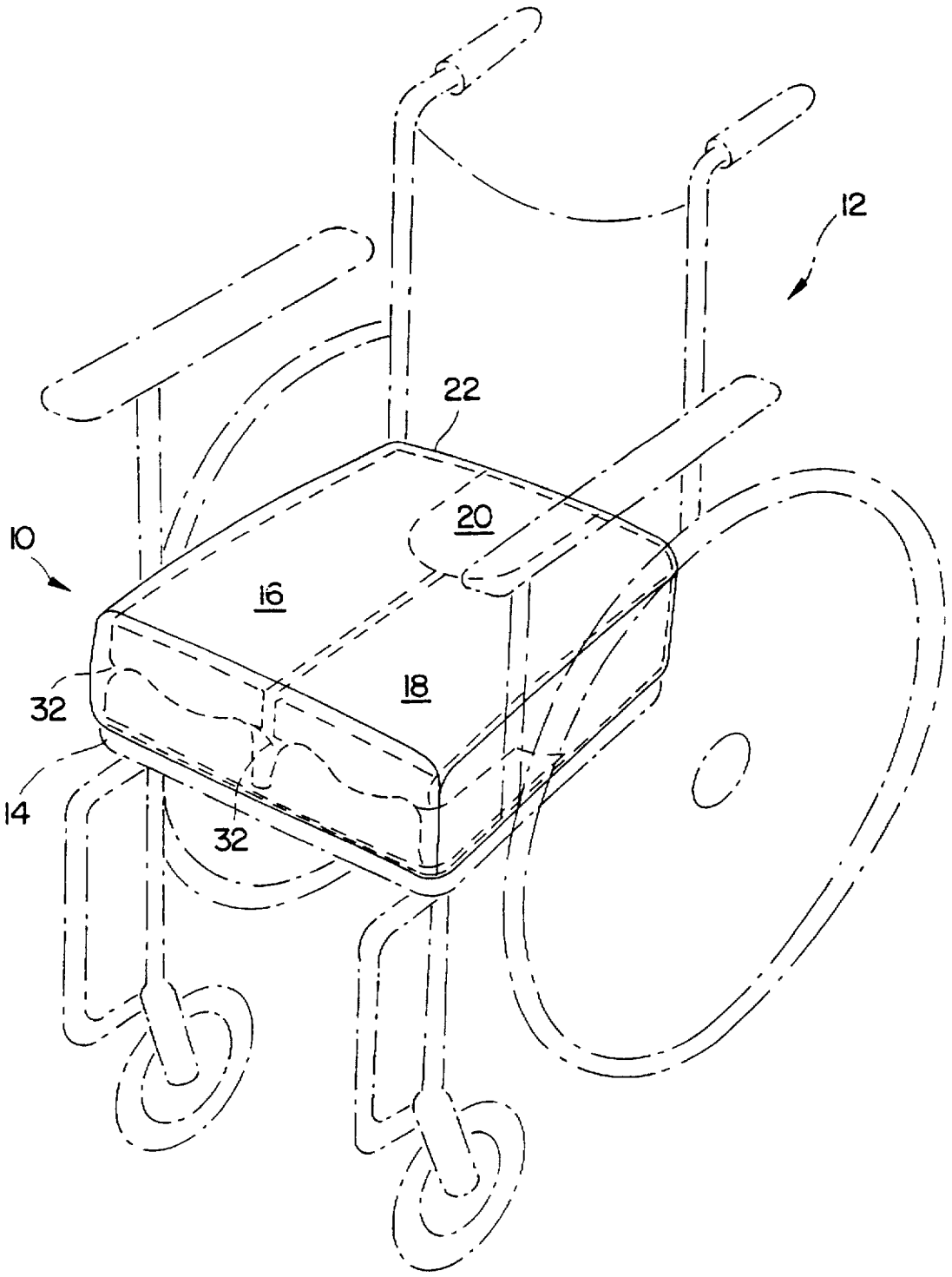
FIG. 1 is a generally top and front perspective view (in partial see through) of an exemplary embodiment of the subject invention being used with an exemplary mobile patient support device, such as a wheelchair.

Repeat use of reference characters throughout the present specification and appended drawings is intended to represent same or analogous features, elements, or steps of the subject invention.

DETAILED DESCRIPTION OF THE PREFERRED EMBODIMENTS

FIGS. 1 through 5 represent a detailed example of a first exemplary embodiment of the subject invention, with a main support body generally 10 provided and received on a conventional wheelchair generally 12. As shown, main support body 10 may be received on a support platform or rails or the like generally 14, forming part of the conventional wheelchair construction. It is to be understood that the main support body 10 may be used in conjunction with other seating arrangements, such as geriatric chairs, or as integrally contained self-adjusting pressure relief cushions for use in other seating circumstances, including general consumer use.

Figure 2:
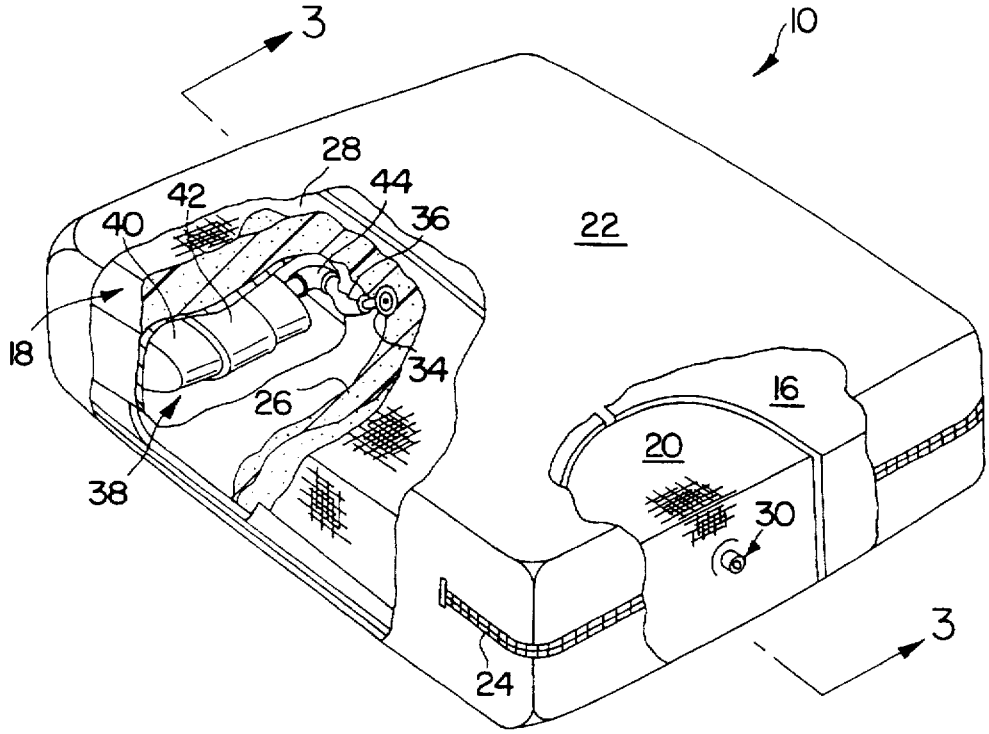
FIG. 2 is a generally top and rear perspective view (enlarged and in partial cutaway) of a first embodiment in accordance with the subject invention.
Figure 3:
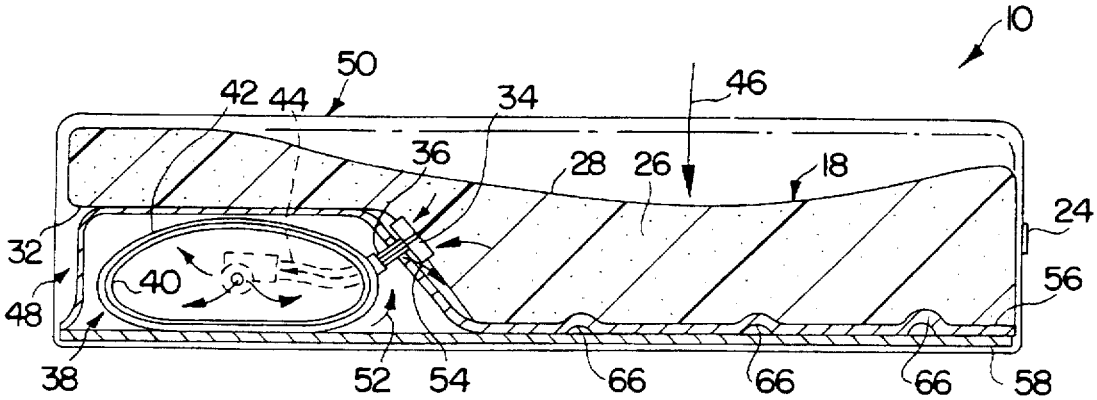
FIG. 3 is a cross sectional view, taken generally along the section line 3—3 in FIG. 2.
Figure 4:
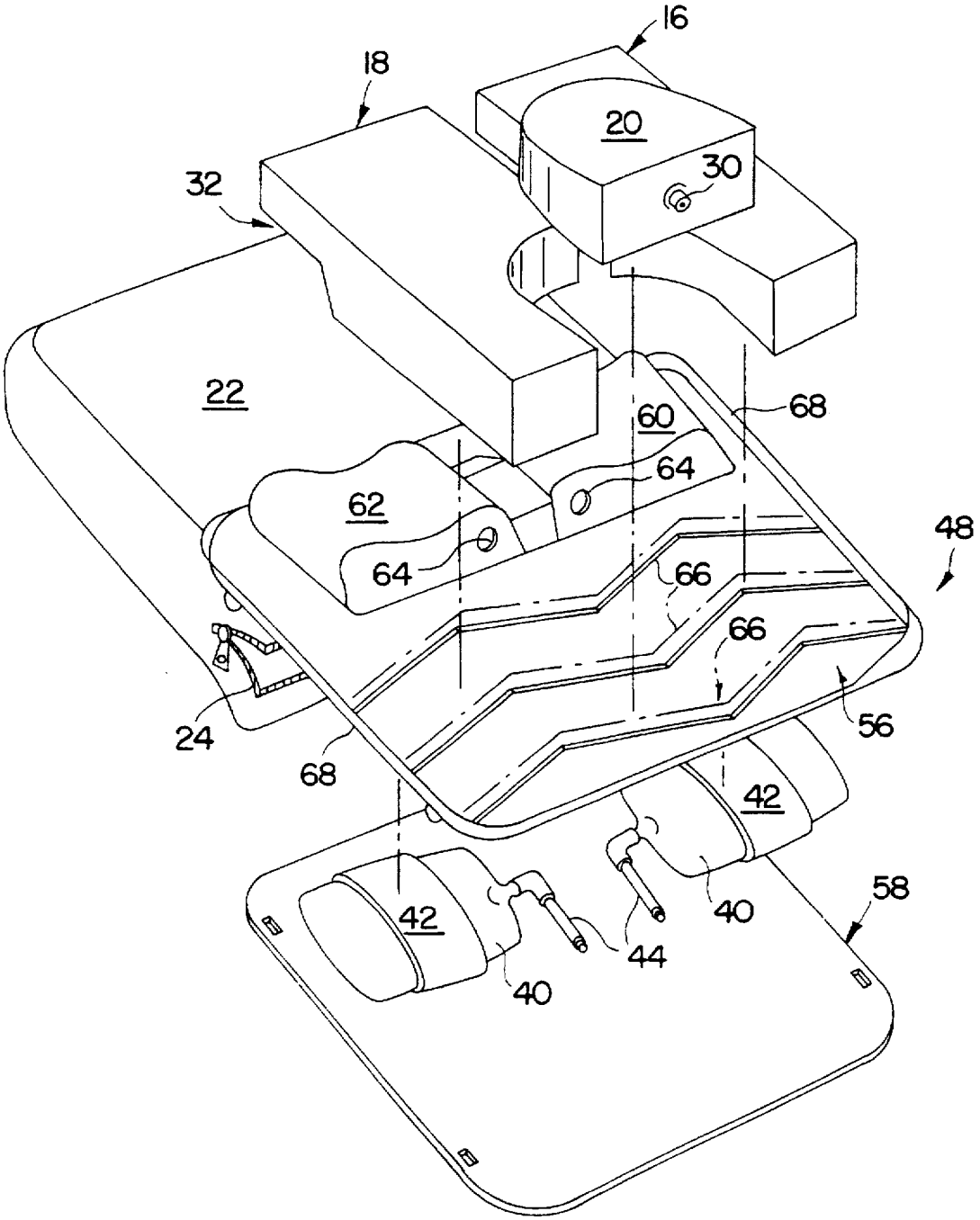
FIG. 4 is a generally top and rear perspective exploded view of the embodiment of present FIG. 1.
Figure 5:
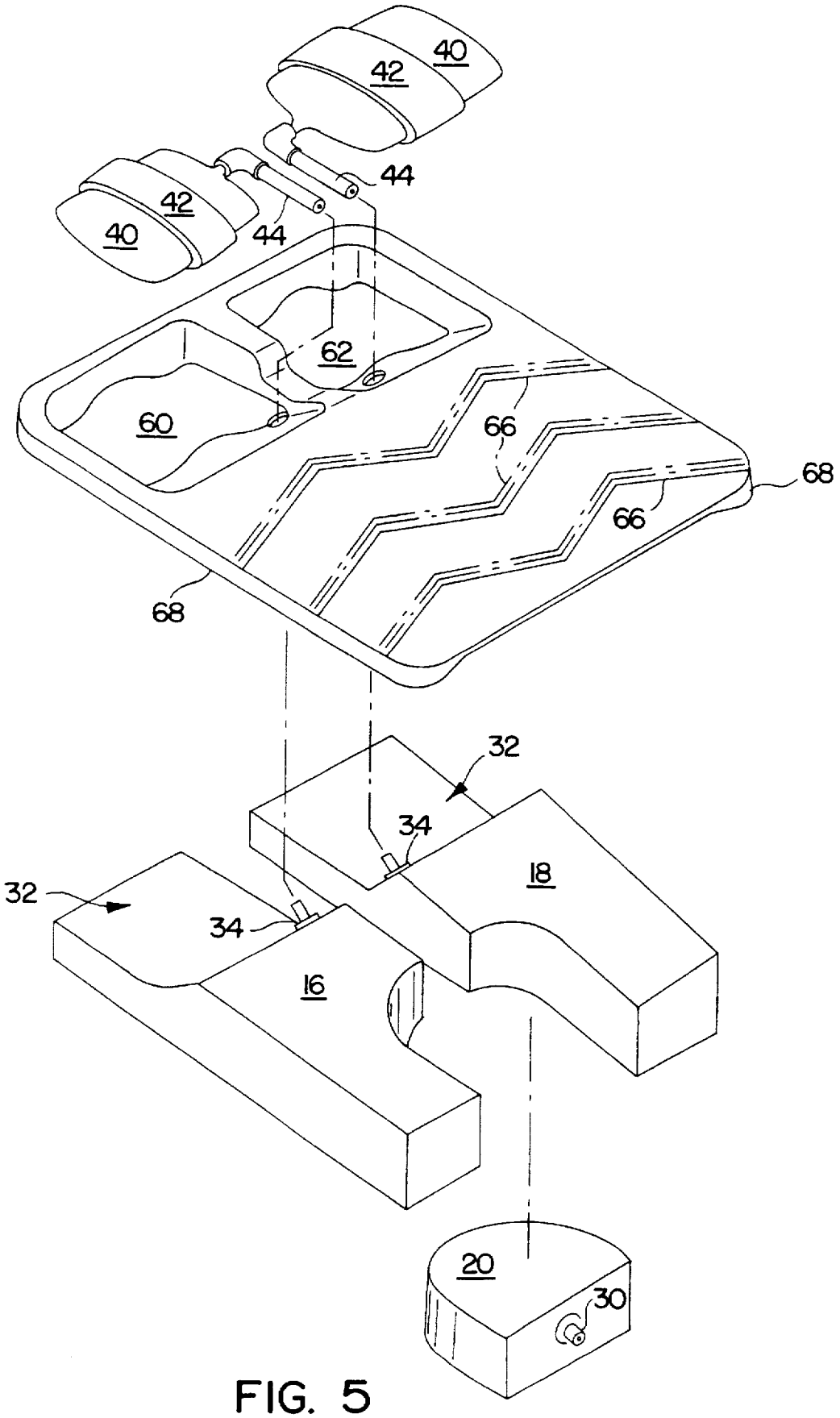
FIG. 5 is a generally bottom and rear exploded perspective view of selected components of the embodiment of present FIG. 1.

FIG. 1 represents main support body 10 as received for use on a conventional wheelchair. FIG. 2 shows an enlarged view of main body 10, generally from a top and rear perspective, and with partial cutaway. FIG. 3 shows a cross sectional view thereof, as taken along section line 3—3 of FIG. 2. As discussed in greater detail below, FIGS. 4 and 5 show respective generally top and bottom (and rearward) perspective exploded views of components forming an exemplary main support body 10. The following discussion refers collectively to such FIGS. 1 through 5.

Main support body 10 may comprise a self-adjusting pressure relief seating system, for use such as with the conventional wheelchair 12, or in other circumstances. As illustrated therein, three exemplary respective support bladders 16, 18, and 20 may be provided within an enclosure such as a zippered case 22. Such case 22 is shown in solid line in present FIG. 1, with support bladders 16, 18, and 20 shown in dotted line, as received therein. Cover 22 may include a zipper 24 or similar enclosing mechanism. Cover 22 may constitute an elastic knit or similar material, preferably so as to have air permeability while being water resistant or repellant.

With a patient seated in the intended orientation on main support body 10, support bladders 16 and 18 comprise respective right and left support areas (from the patient's perspective), with support bladder 20 being centrally located at the back or rear of the seated patient. As represented especially in present FIGS. 2 and 3, support bladders 16, 18, and 20 preferably are formed of an interior having resilient foam generally 26, with a plastic or otherwise air impermeable envelope 28 sealed therearound.

In the case of support bladder 20, an orifice 30 is provided to vent the interior of support bladder 20 with the ambient (i.e., surrounding atmospheric pressure) air. Preferably, interior resilient foam 26 comprises an open-celled foam, so that air moves freely within support bladder 20, confined only by its respective outer layer (plastic envelope 28 or similar) and the orifice 30 formed therethrough. With such venting to atmosphere, air will freely pass in either direction through orifice 30, depending on the loading and compression status of support bladder 20. In other words, as pressure compresses support bladder 20, air within the foam interior 26 is pushed outwardly into the atmosphere via orifice 30. As pressure is released, the resiliency of foam 26 causes support bladder 20 to tend to assume its original unloaded position (as represented by FIGS. 1, 2, 4, and 5). During such time while the foam 26 within support bladder 20 is expanding, air is drawn from the surrounding ambient air via orifice 30 into support bladder 20.

It is to be understood that some embodiments of the subject invention may provide for support bladder 20 instead to be interconnected with various self-adjusting features in accordance with the subject invention, as discussed hereinafter.

FIGS. 1 through 5 represent a cutout portion generally 32 formed on the front, bottom portion of each of support elements 16 and 18. It is to be understood that each such support bladder 16 and 18 likewise preferably includes an interior foam core 26, generally surrounded by a plastic envelope or similar 28. In the case of each of support bladders 16 and 18, the interconnecting orifice 34 associated therewith is directly connected via plastic tubing or similar 36 to self-adjusting reservoir means generally 38 in accordance with the subject invention.

As represented in present FIGS. 1 through 5, such self-adjusting reservoir means 38 may comprise generally an air (or other fluid) bag or chamber generally 40, at least in part surrounded by a generally elastic member 42. The purpose of such features, together with respective tubing or similar 44 is to accommodate pressure dispersions by means of displaced air (or other fluid) from the respective support bladders 16 and 18.

Referring to FIG. 3, for example, exemplary force arrow 46 represents the force of a patient being received on exemplary support bladder 18. As represented in solid line (as compared with the unloaded position, dotted line illustration thereof in FIG. 3), there is a compression of support bladder 18, including the interior resilient foam 26 thereof. Being preferably open-celled foam, trapped air (fluid) within sealed envelope 28 is forced outward through orifice 34 via tubing 36 and via tubing 44 into the interior of bladder 40.

The resilient force of elastic member 42 about such expandable bag 40 reaches an equilibrium point by balancing against the incoming force of air from support bladder 18 (see the air flow arrows represented in present FIG. 3). As pressure (force arrow 46) increases, bladder 40 is enlarged to a new equilibrium point. Conversely, as pressure on foam interior 26 is decreased, the elasticity of member 42 contracts reservoir 40, squeezing air from such reservoir back into support bladder 18, again until an equilibrium point is reached. In this fashion, a self-adjustment feature is provided.

Referring again to present FIG. 3, a protective encasement generally 48 is provided around reservoir means 38, so that pressure on the upper surface generally 50 of main support body 10 will not interfere with operation of reservoir 40. Preferably, such protective means 48 is pneumatically sealed. As represented by arrow 52 (FIG. 3), the enlargement of bladder 40 within the protective device 48 causes a displacement of air. In this instance, tubing 36 is smaller than the opening therefor formed through protective means 48. This permits such displaced air to be exhausted around tubing 36 and to be passed between the outer shell of protective means 48 and the outer skin 28 of support body 18, as also further shown by arrow 54. As noted above, the outer surface or cover 22 is preferably air permeable, which permits such exhausted air to escape into the atmosphere. Conversely, air may be drawn through cover 22 (in directions reverse of arrows 54 and 52) as reservoir 40 contracts.

The protective means generally 48 may comprise respective upper and lower members 56 and 58, formed of molded plastic, plywood, or any other suitable equivalent (i.e., air impermeable and relatively stiff) materials. Molded plastic materials, such as formed of ABS plastics, may be injection molded, vacuum formed, or otherwise molded.

As shown in FIG. 4 in a generally top and rear exploded perspective view, respective regions 60 and 62 may be formed for receiving respective bladders 40, with their respective air tubing or similar 44 emerging via openings 64. The respective top and bottoms 56 and 58 may be sonically welded, glued, or otherwise mutually sealed.

As further represented in present FIGS. 4 and 5, reinforcing elements (formed wavy lines 66 or similar) and side edges or flanges (68) may be added for further strengthening the enclosure means 48.

Referring now to present FIGS. 6A, 6B, and 7, a second exemplary embodiment is illustrated. The primary difference between the first and second exemplary embodiments relates to the enclosure means for protecting reservoir means utilized therewith, as discussed hereinafter.

FIG. 6A represents a generally top and rear perspective view (with partial cutaway) of a second embodiment generally 70 of an improved self-adjusting cushion in accordance with the subject invention. Similar to the first embodiment, a zippered cover generally 22 (mostly cutaway) may enclose three respective support bladders generally 16, 18, and 20. Instead of upper and lower members 56 and 58 for enclosing reservoir means, respective hardened enclosures 72 and 74 are provided. The same contoured foam components as used in support bladders 16 and 18 of the first embodiment generally 10 are also used preferably in the second embodiment generally 70. However, the plastic envelopes or similar 28 of each such support bladder 16 and 18 in this instance also enclose the protective enclosures 72 and 74.

As represented in the cross sectional view of FIG. 7, an enclosure 74 (again of molded plastic or equivalent) is received within the prepared portion (cutout 32) of support bladder 18, within the sealed plastic envelope 28 thereof. Again through tubing and orifices such as represented by 76, 78, and 80, air displaced from foam core 26 (as such core is compressed) passes into bladder 40 and reaches an equilibrium expansion point in conjunction with the elasticity of member 42 received thereabout. Conversely, air may travel from reservoir 40 back into foam core 26, as the pressure (force arrow 46) relatively reduces.

Another difference of the second embodiment from that of the first embodiment relates to the exhaust or vent to ambient atmosphere, as represented by orifice 82 directly interconnecting through cover 22 and envelope 28, to interconnect the ambient atmosphere generally 84 with the interior 88 of molded protective element 74 (outside of bladder 40 therein). Arrows generally 86 represent the flow of air from such interior 88 via orifice 82 into atmosphere 84.

Protective enclosure 74 may be formed of various components, such as a top and bottom molded element brought together and sealed, similar in the manner that upper and lower respective elements 56 and 58 are joined in connection with enclosure means 48 in the first exemplary embodiment.

FIG. 6B illustrates an isolated view of exemplary hardened enclosure 72. It is to be understood that a reservoir 40, elastic band 42, or equivalents of such components are received inside such hardened element. FIG. 6B represents in diagrammatical form the use of a pressure relief valve generally 90 in combination with a check valve 92, all operative in conjunction with venting port 82. Such features may be optionally provided to help prevent a complete collapse (or bottoming out) of the reservoir 40 therein.

Specifically, pressure relief valve 90 may have a set point at which it opens, which set point is higher than the operational set point of the check valve 92. A "cracking" point in a range generally of from about 0.25 PSI to about 0.75 PSI (or more) may be practiced for valve 90. Those of ordinary skill in the art will understand and appreciate operation of such embodiment from the diagrammatical representation thereof, without further specific discussion.

In either the first or second above-described embodiments, each reservoir 40 may have a volume capacity of about 0.5 liters or similar. Different elastic materials, made of rubber or elasticized textile materials or combinations thereof (or even other materials) may be utilized. As represented in the present figures, a silicone rubber sheet approximately four inches wide has been spliced around the bag and glued into place with an overlap, so that a generally constant elastic force is provided all around reservoir 40. It is to be understood that different numbers or sizes of strips, or other elastic materials may be utilized. In some embodiments, an elasticized bag may be used directly in place of a combination of a reservoir and elastic external thereto.

It will be also understood by those of ordinary skill in the art that a combination of upper and lower members 56 and 58 also helps provide a basic shape or frame for main support body 10. Other base elements of similar materials or the like, may be practiced in conjunction with the embodiment of support body 70, as needed for given embodiments to provide desired levels of rigidity, form, or structure.

Still further variations may be practiced. For example, dotted line 94 (FIG. 7) represents an exemplary dividing line, at which two different sections of foam 96 and 98 may be joined (such as by glue or other equivalent means) to form an integral foam core 26. With such an approach, differential foam characteristics may be provided, with in some instances a relatively softer upper foam and relatively harder lower foam, and in some instances vice versa. Of course, other dividing lines (front to rear, left to right, diagonally, etc.) could also be practiced in certain embodiments.

FIGS. 8 through 13 comprise various views of a third embodiment in accordance with the subject invention, generally comprising a variation of the first embodiment thereof. In this instance, respective top and bottom molded plastic elements are integrally combined to provide form and structure and to provide sheltered containment areas for the respective reservoirs. In such third embodiment, however, external air tubing (such as plastic air tubes of ⅛ to ¾ of an inch diameter) emerge from the sealed upper and lower plastic molded pieces, and from the respective support bladders so as to interconnect such as with connectors or couplers used therewith.

Figure 8:
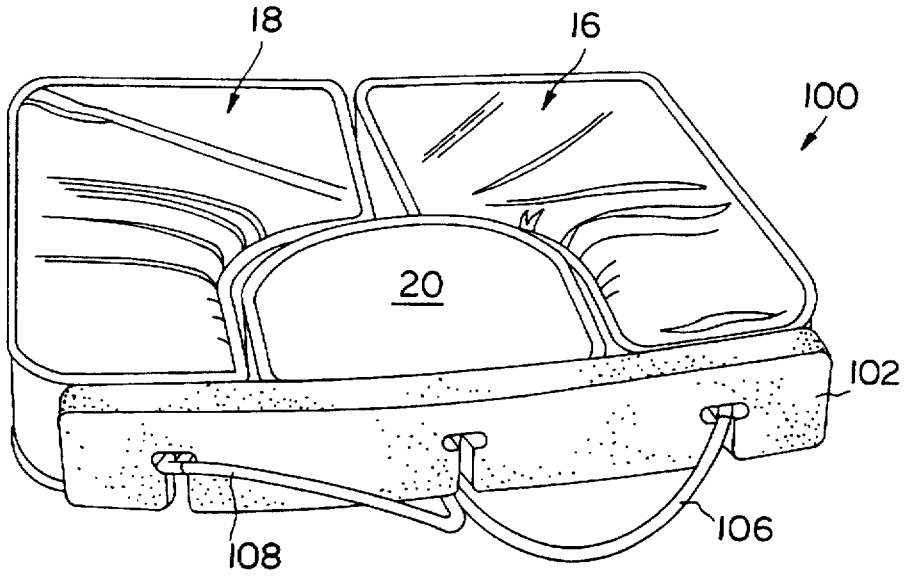
FIGS. 8 through 13 comprise various views of different components of a third embodiment in accordance with the subject invention.

FIG. 8 shows a generally top and rear perspective view generally 100 of the third embodiment. Each of the represented support bladder plastic envelopes are generally the same as the three support elements as shown in conjunction with reference characters 16, 18, and 20 discussed above. A rearward foam element 102 provides an additional guide for the exhaust vent line 104 (FIG. 9) for support bladder 20 and the respective tubing lines 106 and 108 associated with support bladders 16 and 18.

Figure 9:
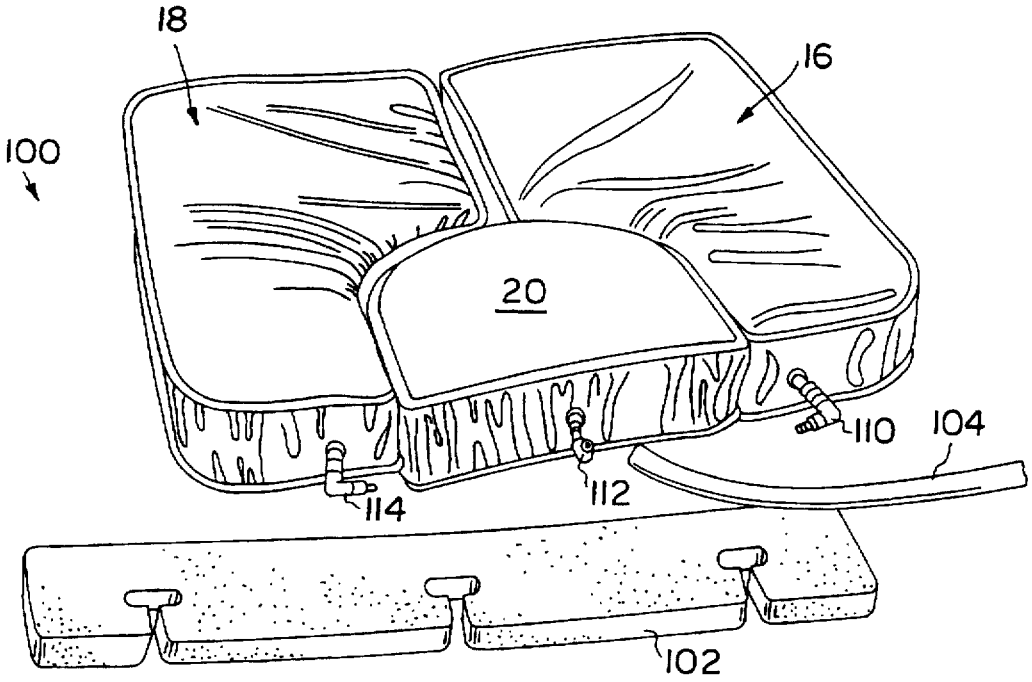
Figure 10:
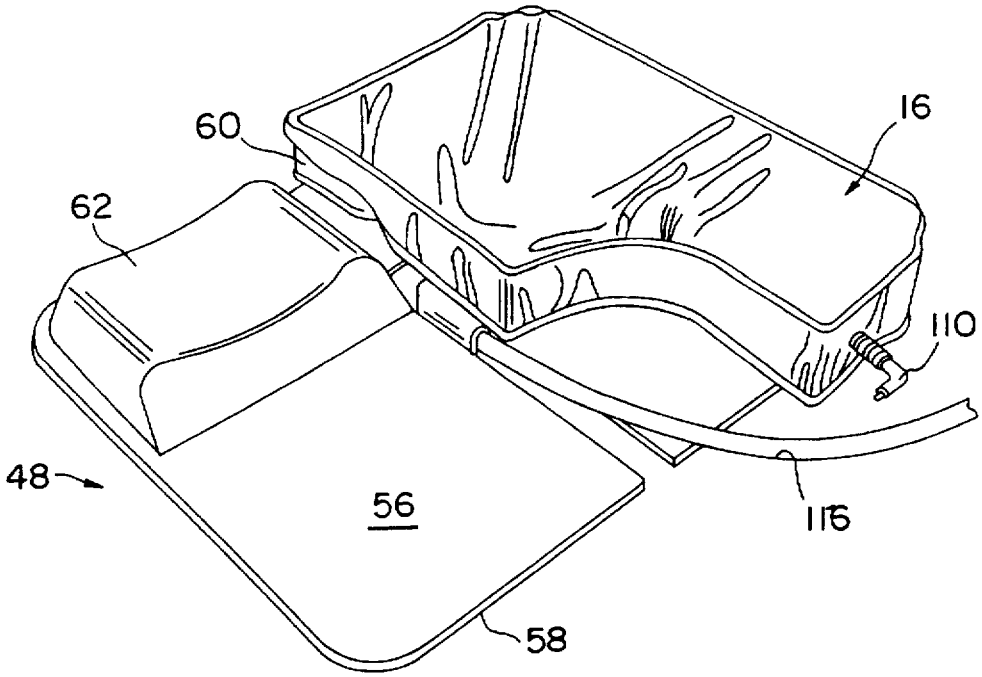

For clarity, the external mesh or other material cover 22 is removed in each of the views comprising FIGS. 8 through 13. FIG. 9 represents a generally top and rear perspective view, with the guiding member 102 turned downward, for greater clarity in viewing the rear members, including respective interconnecting couplers 110, 112, and 114. FIG. 10 similarly shows a generally top and rear perspective view of the third embodiment, with the rearward and one of the side support bladders 20 and 18 respectively removed. Also, enclosure means 48 are represented in an alternative simpler form, without all of the reinforcing elements represented in FIGS. 4 and 5. In such view, the emergence of two pairs of tubes from the hardened enclosure is represented by a single enclosing tube 116.

Figure 11:
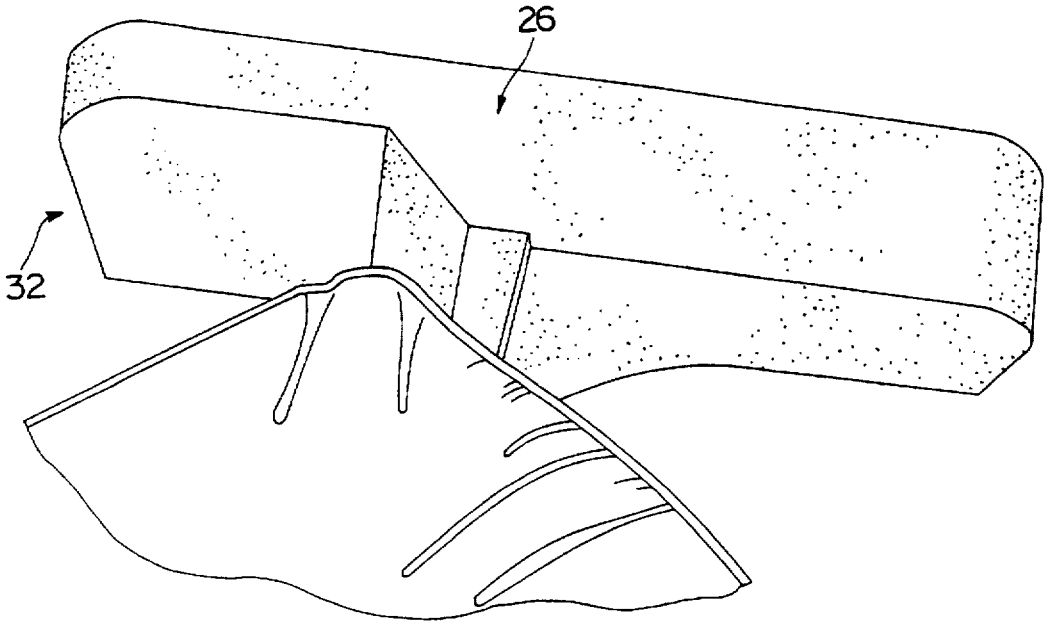

FIG. 11 shows a generally side and slightly bottom elevational view of an exemplary foam core 26 as might be utilized in support bladders 16 and 18 in any of the embodiments herewith. The view represents the cutaway or removed portion 32 which is on the bottom side and generally front portion of the foam core 26, to accommodate presence of the reservoir means generally 38 and related elements.

Figure 12:
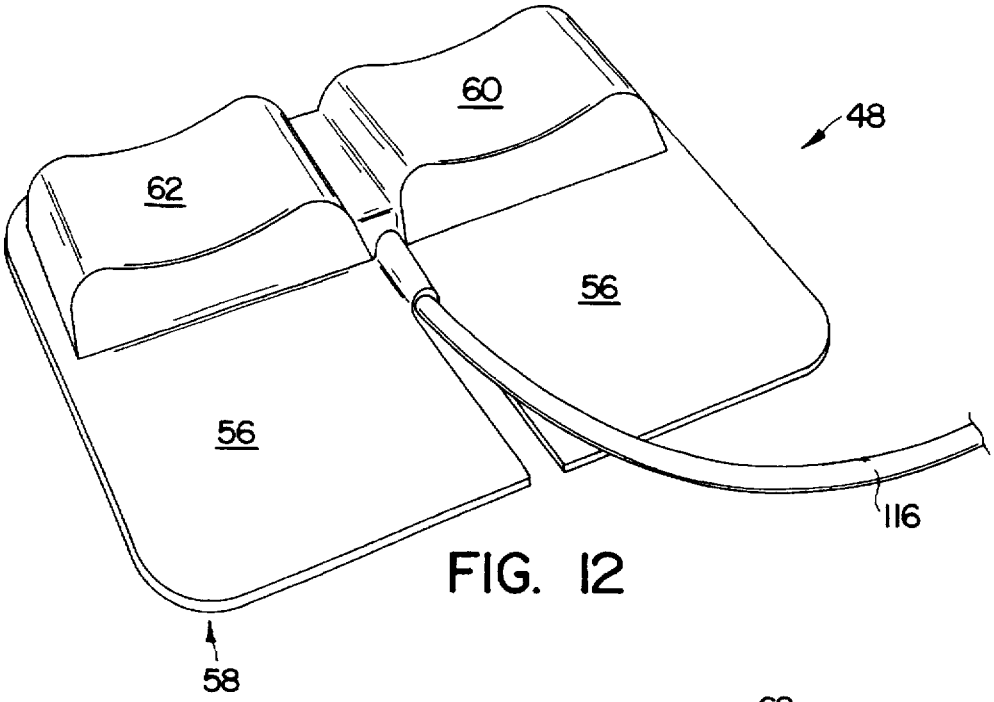

FIG. 12 shows a generally top and rearward perspective view of the third embodiment, with all the support bladders 16, 18, and 20 removed, so as to expose the upper surface of the two combined enclosure elements 56 and 58, and so as to show emergence of the pair of air tubes 106 and 108 (again represented by single enclosing tube 116) associated with the respective air reservoirs beneath support bladders 16 and 18 (i.e., within areas 60 and 62, respectively).

Figure 13:
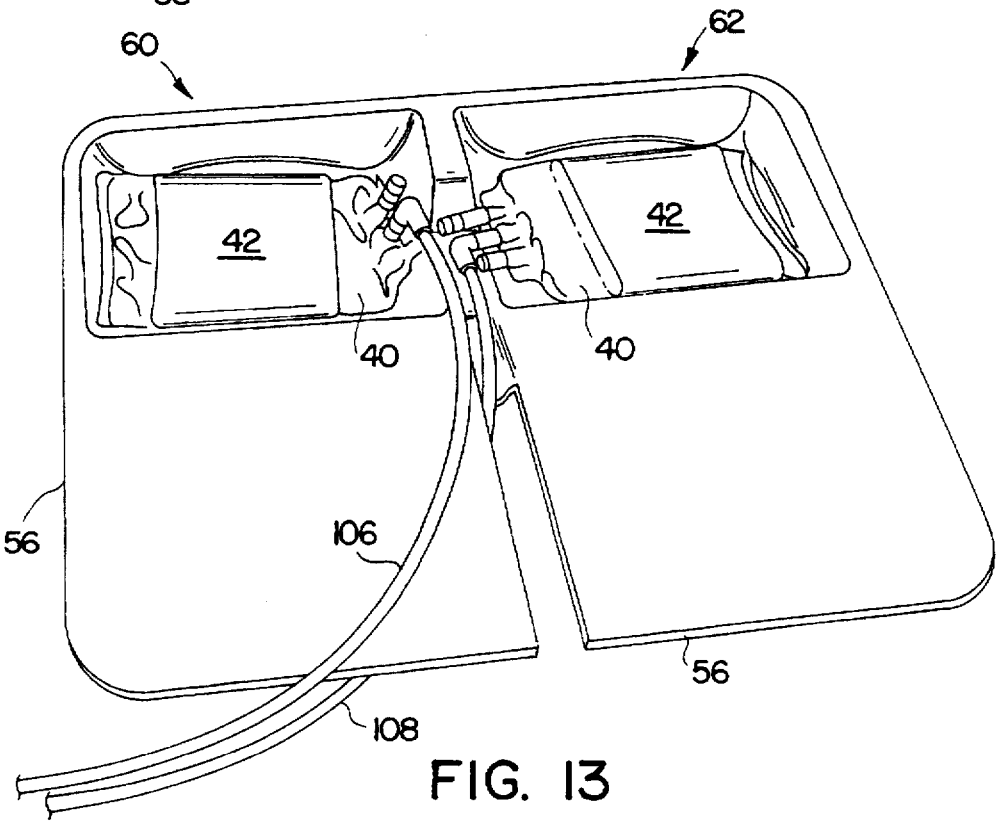

FIG. 13 shows a generally bottom and rear perspective view for the third embodiment, with the bottom element 58 of the combined elements 56 and 58 removed. Such arrangement shows how the pair of reservoirs 40 and their respective elastic means 42 may be received within the respective formed areas 60 and 62, and with respective air tubes 106 and 108 emerging from the enclosed elements.

Figure 14:
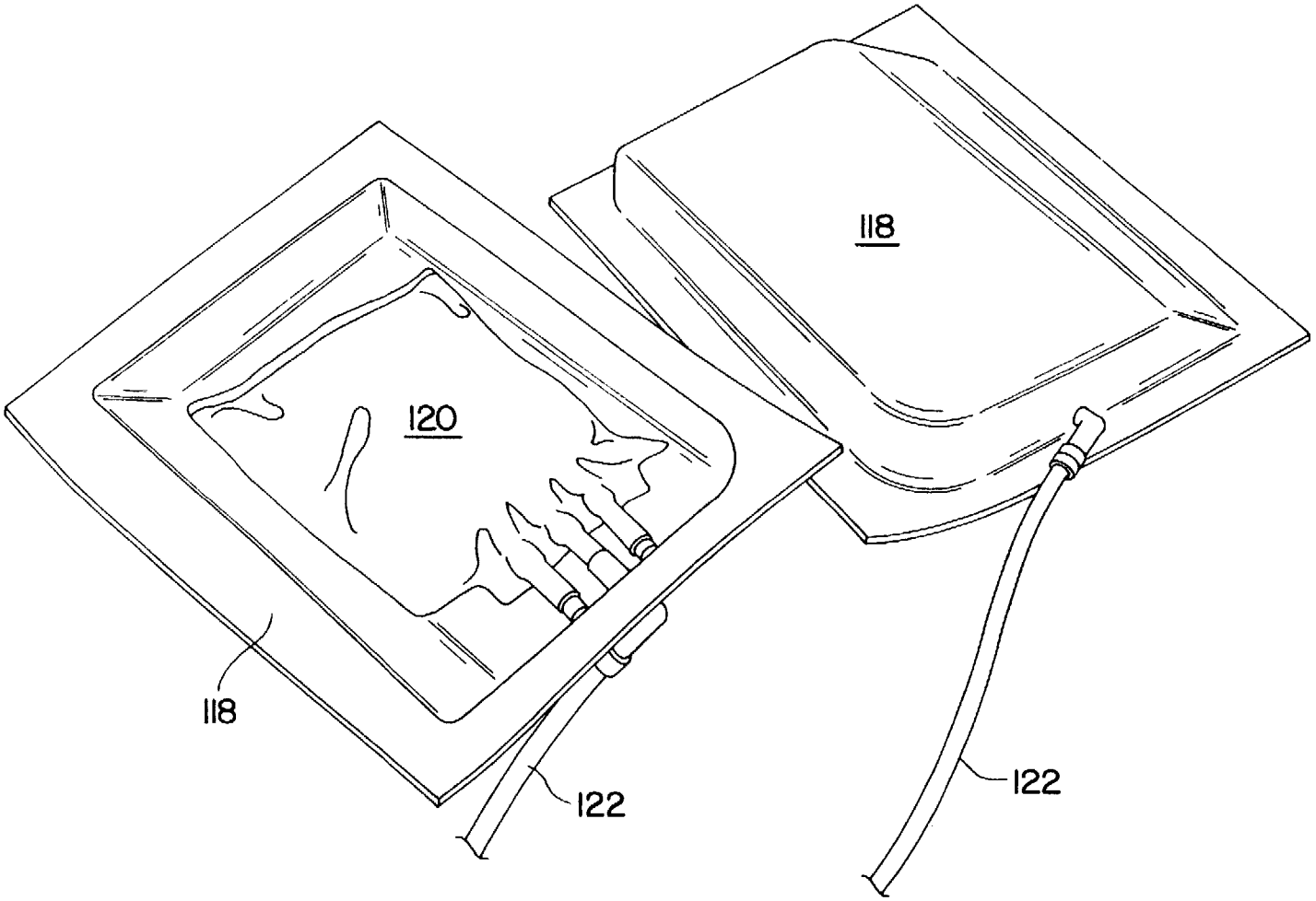
FIGS. 14 and 15 comprise several views of certain aspects of a fourth embodiment in accordance with the subject invention.
Figure 15:
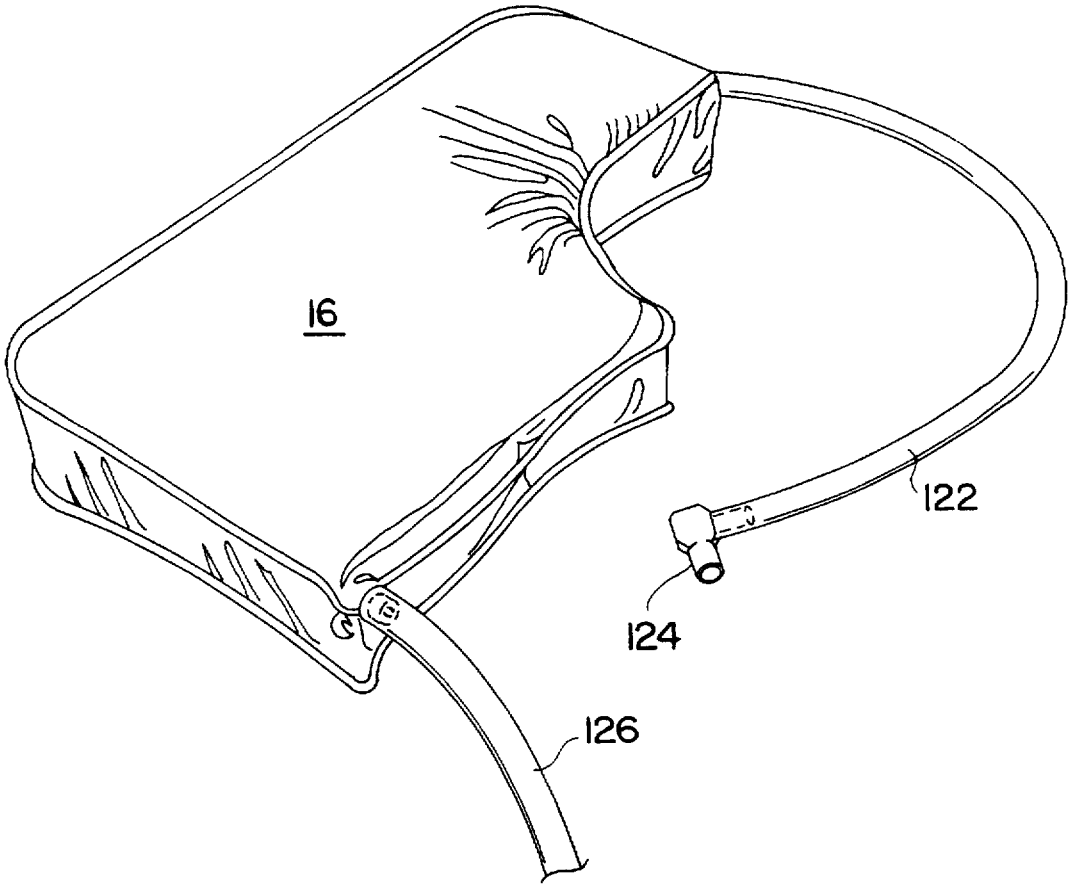

Lastly, FIGS. 14 and 15 comprise views of select portions of a fourth embodiment in accordance with the subject invention, generally comprising a variation of the second embodiment as described above. More specifically, FIG. 14 represents respective lower (the left pictured element) and upper (the right pictured element) views of the upper element 118 of two members to be brought together so as to form an enclosure, analogous to hardened enclosures 72 and 74 of present FIGS. 6A, 6B, and 7. For clarity and greater detail, the elastic band is removed from the reservoir 120 in the view of FIG. 14. In this fourth embodiment, respective air tubes such as 122 emerge and are elongated for interconnecting with respective support bladders, 16 and 18, generally as in accordance with the third embodiment discussed above. In other words, the fourth embodiment combines the respective protective enclosure features for the respective air reservoirs (from the second embodiment) with the elongated air tubing features (from the present third embodiment). FIG. 15 represents an exemplary support bladder 16 for the fourth embodiment with an associated extended air tube 122 and coupling device 124 therefor, and a reservoir means exhaust line generally 126.

It is to be understood that all of the above embodiments make use of features which combine so as to form an integrally contained or enclosed improved self-adjusting therapeutic support cushion. In other words, all of the self-adjustment features of the subject embodiments may be contained within their respective cover 22, or the like, so as to be provided in a single, self-contained cushion not requiring any external power for actuation of plural self-adjustment features for respective adjustment zones.

It is to be understood that further variations, additional features, or optional features may be practiced. For example, quick disconnect/connect couplers or the like may be utilized in conjunction with the various air tubing interconnections. The pressure relief valve 90 and check valve 92 features of present FIG. 6B may be utilized in conjunction with other embodiments of the subject invention.

Still further, it is to be understood that different dimensions may be practiced, as well as different shapes for the respective support bladders herewith. Likewise, it will be appreciated that different materials, foam densities and ILDs, and other characteristics may be varied generally in accordance with the subject invention, without departing from the spirit and scope thereof. Still further embodiments may be practiced, outfitted into all manner of transportation vehicles and other settings, both commercial and consumer oriented.

It should be further understood by those of ordinary skill in the art that the foregoing presently preferred embodiments are exemplary only and that the attendant description thereof is likewise by way of words of example rather than words of limitation, and their use does not preclude inclusion of such modifications, variations, and/or additions to the present invention as would be readily apparent to one of ordinary skill in the art.

What is claimed is:

1. A self-adjusting therapeutic pressure relief seating system, comprising:

at least one resilient support element having a fluid impermeable exterior, said exterior defining an orifice therethrough to the interior of said support element;

at least one self-adjusting reservoir means in fluid communication with said support element orifice for accommodating to equilibrium fluid flow through said orifice responsive to changes in pressure received by said support element exterior;

protective encasement means for protectively receiving said reservoir means so as to isolate said reservoir means from direct contact with changes in pressure to said support element exterior; and fluid permeable cover means received about said support element, said reservoir means, and said encasement means for forming an integral pressure relief seating system.

2. A self-adjusting therapeutic pressure relief seating system as in claim 1, further including at least a second resilient support element in respective fluid communication with at least a second self-adjusting reservoir means, and wherein said protective encasement means includes two chambers for respectively protectively receiving and respectively isolating such two reservoir means, all of which components are collectively received within said cover means.

3. A self-adjusting therapeutic pressure relief seating system as in claim 2, wherein:

said resilient support elements respectively in fluid communication with respective reservoir means are situated in relative respective right and left sides of said seating system; and further wherein said seating system further includes a third resilient support element received within said cover means in a relatively central and rearward portion thereof, with the orifice of said third resilient support element being open to atmosphere via said fluid permeable cover means.

4. A self-adjusting therapeutic pressure relief seating system as in claim 2, wherein said protective encasement means comprise air impermeable pneumatically sealed members, which sealed members form respective openings therein for said fluid communication and for permitting fluid within said encasement means chambers and exterior to said reservoir means therein to adjust as the volume of said reservoir means adjusts during operation thereof.

5. A self-adjusting therapeutic pressure relief seating system as in claim 4, wherein said sealed members comprise relatively stiff molded plastic respective upper and lower members.

6. A self-adjusting therapeutic pressure relief seating system as in claim 5, wherein said sealed members further include reinforcing elements for added encasement means strength to isolate said respective reservoir means from direct contact with support element pressure changes due to changing user loading thereon.

7. A self-adjusting therapeutic pressure relief seating system as in claim 1, wherein said support element comprises a resilient air permeable foam core surrounded by a synthetic material air impermeable envelope, said envelope forming said orifice therethrough.

8. A self-adjusting therapeutic pressure relief seating system as in claim 7, wherein said foam core is comprised of at least two distinct components of foam having selected differential characteristics and selected predetermined mutually cooperative shapes collectively forming the shape of said support element.

9. A self-adjusting therapeutic pressure relief seating system as in claim 7, wherein said self-adjusting reservoir means comprises a fluid impermeable chamber surrounded at least in part by a generally elastic member, and further including tubing connecting the interior of said reservoir means chamber with said support element orifice.

10. A self-adjusting therapeutic pressure relief seating system as in claim 9, further including a second resilient support element and respective second self-adjusting reservoir means operative therewith, both received within said cover means.

11. A self-adjusting therapeutic pressure relief seating system as in claim 10, further including a third resilient support element received within said cover means, the orifice of which third resilient support element is open to atmosphere via said fluid permeable cover means.

12. A self-adjusting therapeutic pressure relief seating system as in claim 10, wherein said protective encasement means comprise respective molded elements cooperating to form respective sheltered containment areas for said respective reservoir means.

13. A self-adjusting therapeutic pressure relief seating system as in claim 12, wherein said seating system further includes external air tubing interconnecting between respective components via respective couplers, and further including an additional foam guide element for guiding said external air tubing.

14. A self-adjusting combination resilient foam and air based integral cushion, for dynamic user pressure relief without requiring external energy, sensory feedback control, or powered pumps or valving components, said integral cushion comprising:

three respective support bladders configured generally in relative left, right, and center rear positions within said cushion, each of said support bladders having a respective air permeable foam core surrounded by an air impermeable envelope, said envelope defining an orifice therethrough;

a pair of self-adjusting air reservoir means respectively operatively associated with said left and right situated support bladders for accommodating air displaced relative thereto per changing user loading conditions on such left and right support bladders, with the orifice of said center rear support bladder being open to atmosphere;

a protective relatively stiff shell surrounding said pair of reservoir means in respective chambers thereof for isolating said reservoir means from direct contact with the changing user loading conditions experienced by said support bladders; and an air permeable cover received about said bladders, said air reservoir means and said protective shell.

15. A self-adjusting combination resilient foam and air based integral cushion as in claim 14, wherein said relatively left and right support bladders have respective cutouts for accommodating the locations of said respective protective shell chambers.

16. A self-adjusting combination resilient foam and air based integral cushion as in claim 14, wherein said protective shell comprises air impermeable molded plastic with said chambers thereof respectively pneumatically sealed and forming respective openings thereto for the passage of air relative to said chamber as said reservoir means alternately expands and contacts therein.

17. A self-adjusting combination resilient foam and air based integral cushion as in claim 14, wherein said air reservoir means comprise respective fluid impermeable chambers with respective surrounding resilient members and with air passages interconnecting the interiors of said chambers with their respective operatively associated support bladders.

18. A self-adjusting therapeutic pressure relief seating system, comprising:

at least one resilient support element having a resilient foam core and a fluid impermeable exterior covering, said exterior covering defining an orifice therethrough to the exterior of said support element, wherein said foam core has a predetermined contoured shape for accommodating additional components within said fluid impermeable exterior covering;

a hardened relatively non-crushable and fluid impermeable enclosure received within said support element exterior covering and situated within said foam core contoured accommodation therefor, said enclosure defining an exhaust port interconnected with said support element orifice and said enclosure defining a second opening therein directed to the interior of said support element exterior covering; and at least one self-adjusting reservoir means received within said hardened enclosure and in fluid communication with said support element interior via said hardened enclosure second opening for accommodating to fluid equilibrium fluid flow relative to said support element responsive to changes in pressure received by said support element exterior covering.

19. A self-adjusting therapeutic pressure relief seating system as in claim 18, further including fluid permeable cover means received about said support element, including said reservoir means and said hardened enclosure situated within said support element exterior covering, for forming an integral pressure relief seating system.

20. A self-adjusting therapeutic pressure relief seating system as in claim 19, further including a respective second resilient support element and functionally cooperative second hardened enclosure and self-adjusting reservoir means operative therewith.

21. A self-adjusting therapeutic pressure relief seating system as in claim 20, further including a third resilient support element with an orifice thereof vented to atmosphere via said fluid permeable cover means.

22. A self-adjusting therapeutic pressure relief seating system as in claim 18, further including a pressure relief valve and a check valve collectively operatively associated with said exhaust port, with said pressure relief valve having an opening set point set higher than the operational set point of said check valve, so that collectively said valves automatically operate to help prevent a relatively complete collapse of said reservoir means.

23. A self-adjusting therapeutic pressure relief seating system, comprising:

at least one resilient support element having a resilient foam core and a fluid impermeable exterior covering, said exterior covering defining two orifices therethrough to the exterior of said support element, wherein said foam core has a predetermined contoured shape for accommodating additional components within said fluid impermeable exterior covering;

a hardened relatively non-crushable and fluid impermeable enclosure received within said support element exterior covering and situated within said foam core contoured accommodation therefor, an exhaust line from said enclosure to atmosphere emerging through one of said support element orifices, and a pressure adjusting line to said enclosure interconnected with the other of said support element orifices; and at least one self-adjusting reservoir means received within said hardened enclosure and in fluid communication with said support element interior via said pressure adjusting line of said hardened enclosure for accommodating to fluid equilibrium fluid flow relative to said support element responsive to changes in pressure received by said support element exterior covering.

24. A self-adjusting therapeutic pressure relief seating system as in claim 23, further including fluid permeable cover means received about said support element, including said reservoir means and said hardened enclosure situated within said support element exterior covering, for forming an integral pressure relief seating system.

25. A self-adjusting therapeutic pressure relief seating system as in claim 24, further including a respective second resilient support element and functionally cooperative second hardened enclosure and self-adjusting reservoir means operative therewith.

26. A self-adjusting therapeutic pressure relief seating system as in claim 25, further including a third resilient support element with an orifice thereof vented to atmosphere via said fluid permeable cover means.

27. A method of providing dynamic self-adjusting pressure relief with an integral combination resilient foam and air based cushion, without requiring external energy, sensory feedback, control, or powered pumps or valving components, said method comprising:

providing a plurality of respective support bladders in a predetermined configuration within a cushion, with each of said support bladders having a respective air permeable foam core surrounded by an air impermeable envelope, said envelope defining an orifice therethrough;

providing at least one self-adjusting air reservoir means operatively associated with at least one of said support bladders for accommodating air displaced relative thereto per changing user loading conditions on the associated support bladder;

protectively enclosing said air reservoir means so as to isolate said reservoir means from direct contact with the changing user loading conditions experienced by the associated support bladder; and integrally enclosing the components of said cushion in an air permeable cover.

28. A method as in claim 27, further comprising:

providing three of said support bladders in a predetermined configuration with relative left, right, and rear central respective positions thereof;

providing a second protectively enclosed self-adjusting air reservoir means, with such two reservoir means operatively associated respectively with the left and right positioned support bladders via said respective orifices thereof; and leaving the orifice of the rear central positioned support bladder to vent to atmosphere through the cover.

29. A method as in claim 28, further including configuring the shape of the left and right positioned support bladders so as to accommodate their respective reservoir means positioned therebeneath.

30. A method as in claim 28, further including encasing said reservoir means and their protective enclosures within their respectively associated support bladders.

31. A method as in claim 28, further including selectively forming the respective foam core of each support bladder from plural, differentiated components of foam so as to further customize the support characteristics of said cushion.

* * * * *